United States Patent [19]

Jaseck et al.

[11] Patent Number: 4,958,530

[45] Date of Patent: Sep. 25, 1990

[54] MOISTURE SEAL FOR A TRANSLATABLE PINION GEAR ASSEMBLY IN A STARTER MOTOR

[75] Inventors: James E. Jaseck, Dearborn; Eric A. Fereshetian, Livonia, both of Mich.

[73] Assignee: Ford Motor Company, Dearborn, Mich.

[21] Appl. No.: 401,724

[22] Filed: Aug. 31, 1989

[51] Int. Cl.[5] ..... F02N 15/06

[52] U.S. Cl. ..... 74/7 A; 74/7 R; 74/7 C

[58] Field of Search ..... 74/6, 7 R, 7 A, 7 E, 74/7 C; 277/152; 290/38 C, 48

[56] References Cited

U.S. PATENT DOCUMENTS

| | | | |
|---|---|---|---|
| 3,772,921 | 11/1973 | Carlson et al. | 74/7 A |
| 3,922,558 | 11/1975 | Hollyoak | 290/38 A |
| 3,955,427 | 5/1976 | Squires | 74/6 R |
| 4,104,926 | 8/1978 | Wilson | 74/6 |
| 4,206,656 | 6/1980 | Hollyoak | 74/6 |
| 4,665,320 | 5/1987 | Debello | 290/48 |
| 4,718,290 | 1/1988 | Murata et al. | 74/7 A |
| 4,829,195 | 5/1989 | Takami | 290/48 |

*Primary Examiner*—Allan D. Herrmann

*Attorney, Agent, or Firm*—Paul K. Godwin, Jr.; Clifford L. Sadler

[57] ABSTRACT

Starter motor for use with an internal combustion engine which includes a seal between the housing and the translatable clutch/pinion gear assembly so as to prevent contaminants from entering the motor/solenoid portion of the housing. The seal is temporarily broken whenever the clutch/pinion gear is translated to be engaged with the driven gear of an internal combustion engine.

8 Claims, 2 Drawing Sheets

MOISTURE SEAL FOR A TRANSLATABLE PINION GEAR ASSEMBLY IN A STARTER MOTOR

BACKGROUND OF THE INVENTION

1. Field of the Invention

The present invention is directed to the field of starter motors for internal combustion engines and more specifically to the area of providing a watertight seal between the housing and the engageable gearing that interconnects the starter motor to the engine.

2. Description of the Prior Art

Several prior art patents have indicated the desirability of preventing dirt, water and other debris from entering the electric motor and solenoid portion of a starter motor for an internal combustion engine. The following patents all provide various sealing mechanisms intended to confine the contaminants to the pinion drive mechanism that is engageable with the drive gear on the engine.

U.S. Pat. No. 4,718,290 is directed to a starter motor for use in a lawn mower engine in which a horizontally oriented flywheel has a cooling fan attached that has a tendency to force foreign matter into the portion of the starter motor housing containing a vertically translatable pinion gear. A rigid wall extends from the internal portion of the housing towards the sleeve that envelopes an overrunning clutch. The wall contains a central hole which corresponds to the diameter of the clutch so as to allow the clutch to vertically reciprocate through the central hole of the wall. The inside surface of the wall is always in contact with the outside surface of the sleeve regardless of the position of the overrunning clutch.

U.S. Pat. No. 4,206,656 is directed to a starter motor which utilizes an internal cup-shaped wall to extend around an overriding clutch when it is in its retracted position. The cup-shaped wall contains a central aperture through which the sleeve of the overriding clutch extends throughout its reciprocating movement. The cup-shaped wall contains a resilient member surrounding the central aperture so as to be in continuous contact with the sleeve throughout its reciprocating movement.

U.S. Pat Nos. 4,104,926 and 3,955,427 describe a starter motor containing a resilient annular seal secured to the inside of the housing so as to encircle and make contact with the outer sleeve of an overrunning clutch. Throughout the reciprocating movement of the clutch, with the pinion gear, the resilient seal continually maintains contact with the outer sleeve.

U.S. Pat. No. 3,772,921 describes a starter motor in which an annular lip seal resides on the outer periphery of a translatable pinion gear so as to make contact with the concentric housing surrounding the pinion gear throughout its translation into and out of engagement with the driven gear on a associated engine.

In each of the prior art patents cited above, the sealing that occurs to prevent contaminants from entering the electrical motor and solenoid portions of the motor housing is provided to continually seal the moveable elements (clutch or pinion gear) during both their reciprocal axial translation and rotational movement after engagement with the driven gear of an engine.

It is believed that such continual sealing produces potential wear and degradation of the seal, drag on the motor, and potential seizing between the seal and the moveable elements Seizing is especially problematic in that the retraction of the pinion gear from engagement with the driven gear may be prevented.

SUMMARY OF THE INVENTION

The present invention overcomes the disadvantages noted in the prior art by providing a seal between the relatively stationary housing and the translatable components of the starter motor by maintaining a watertight seal only during the time the motor is in a deenergized state. As soon as the motor is energized and the pinion gear is translated towards the flywheel or driven gear of the engine, the seal is broken. Such a feature is found to be desirable and adequate for automotive use since the energization of a starter motor normally takes place when the vehicle is stationary and not subjected to air driven contaminants being forced into the pinion gear portion of the motor housing. However, when the engine has been started and the vehicle is in motion, the starter motor is deenergized, the seal is maintained and any contaminants forced into the pinion gear portion are prevented from entering the motor portion of the housing.

It is therefore an object of the present invention to provide a sealing mechanism for an electrical starter motor that is suitable for extended lifetime due to the fact that the seal is broken prior to the translatable/rotatable elements being rotated. It is another object of the present invention to provide a starter motor seal that does not add loading to the drive mechanism.

DETAILED DESCRIPTION OF THE PREFERRED EMBODIMENT

Figure 1:
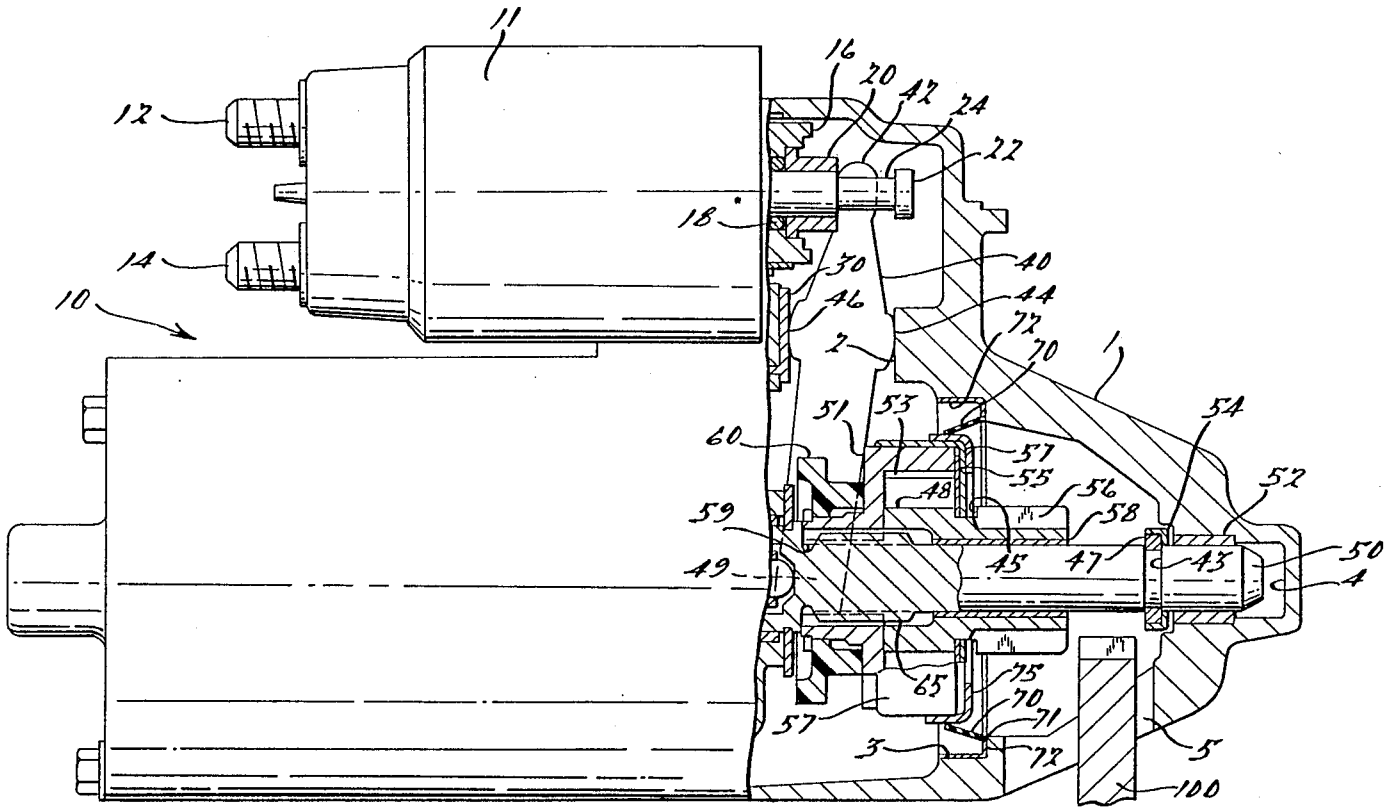
FIG. 1 an elevational plan and partial cross section view of a starter motor which illustrates the present invention in its disengaged state with respect to the drive gear.

In FIG. 1, a starter motor 10 is shown which embodies the present invention. The starter motor 10 is shown in its deenergized state wherein the elements of the cross sectional portion are in a first retracted position. The starter motor 10 is mounted adjacent to an internal combustion engine (not shown) from which a driven gear 100 is externally accessible. The starter motor 10 comprises a housing 1 that is cast with an opening 5 that accepts the driven gear 100 extending from the internal combustion engine. A solenoid 11, containing a pair of electrical terminals 12 and 14, is also mounted on the housing 1 in such a way that the solenoid 11 and the housing 1 form a relatively watertight unit with the exception of opening 5. In some mounting configurations, the starter motor 10 is placed in such a position that water, dirt and other contaminating particles have a tendency to intrude into the opening 5 when the car is in operation. The present invention provides a seal that prevents those contaminants from entering the solenoid and electrical motor portion of the housing.

The housing 1 provides support for the various movable elements contained therein. A socket 4 is formed in the housing 1 and provides a seat for a bearing 52. The bearing 52 allows rotation of a starter output shaft 50 that is axially mounted therein. The starter output shaft 50 is connected in a conventional manner to a planetary gear drive mechanism (not shown) within the housing of the motor 10. The electric motor (not shown) is also within the housing 1 and when energized provides the rotary drive directly to the planetary gear drive mechanism and the starter output shaft 50 so that the shaft 50 rotates about its longitudinal axis. The output shaft 50 contains a set of external spline teeth 65 at the end opposite the bearing 52. A groove 43 is formed in the output shaft 50 for the attachment of a "C" clip 47 and retaining ring 54, adjacent to bearing 52. A lubricated pinion gear bearing 58 surrounds the portion of the output shaft 50 between the spline teeth 65 and the "C" clip 47. The bearing 58 is retained within the starter drive pinion gear 56 so as to allow low friction sliding of the pinion gear 56 along the output shaft 50. The pinion gear 56 also contains a shank portion 48 and an external circumferential groove 45 between the shank 48 and the gear teeth. An overrunning clutch 51 contains a washer 55 which is captured within the groove 45 of the pinion gear 56 by a metal drive cup 57. The overrunning clutch 51 contains a set of rollers 53 that are spring loaded in a conventional manner to bear on the shank 48 and force rotation of the shank 48 and the pinion gear 56 in one direction only. The overrunning clutch 51 also contains a set of internal teeth 59 that mesh with the spline teeth 65 on the output shaft 50.

The clutch/pinion gear assembly is controllably positioned along the shaft 50 by the movement of a lever 40 that is connected to a flange 60 attached to the clutch 51. The other end of the lever 40 is connected to a solenoid pin 24 and is pivoted at central cams 44 and 46 captured between planar surfaces 2 and 30.

The solenoid 11 contains a plunger 16 which is spring biased outwardly when the solenoid 11 is deenergized. The plunger 16 is retracted inwardly (to the left of the example shown in FIG. 1) by the energization of the solenoid 11. A cavity within the plunger 16 contains a spring 18 for biasing a ring 20 outwardly on the pin 24. The pin 24 contains a stop 22 formed at its outer end and the upper portion 42 of the lever 40 is positioned to be captured between the ring 20 and the stop 22 to move therewith when the plunger 16 is moved between its first (deenergized) and its second (energized) positions. In use, terminals 12 and 14 are connected to a switch (not shown) internal to the solenoid 11 to provide power to the motor, when the switch is closed.

A seal is provided between the overrunning clutch 51 and the housing 1 during the time the motor 10 is in a deenergized state. The seal includes an annular shaped lip flange 70 formed of a resilient elastomeric material supported on a rigid frame 72 along an annular joint 71. A circumferential step 3 is formed on the internal surface of the housing 1 at a position which will allow the elastomer lip 70 to contact a portion of the overrunning clutch 51 when it is in its deenergized (first) position. The overrunning clutch 51 contains a cylindrical sealing member 75 which contains a flange extending over a small portion of the outer periphery so as to extend the surface of the clutch 51 outward (the thickness of sealing member 75) at the point of contact with the elastomer 70 and create a substantially water-tight seal that prevents contaminants from entering the motor and solenoid areas when the clutch/pinion assembly is in its deenergized position.

Figure 2:
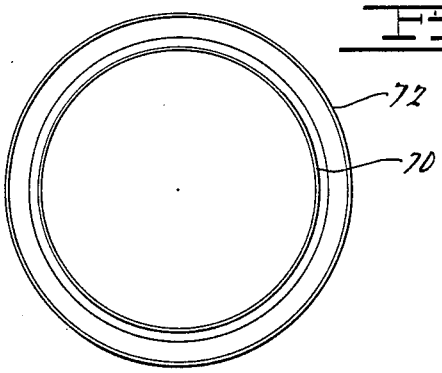
FIG. 2 is an elevational view of the seal element of the present invention shown in cross section in both FIGS. 1 and 3.

The plan view of the lip flange 70 is shown in FIG. 2. The rigid annular frame 72 is shown as providing support for the lip flange 70. The lip flange 70 is formed of a resilient elastomer material and is bonded to the frame 72 at joint 71.

Figure 3:
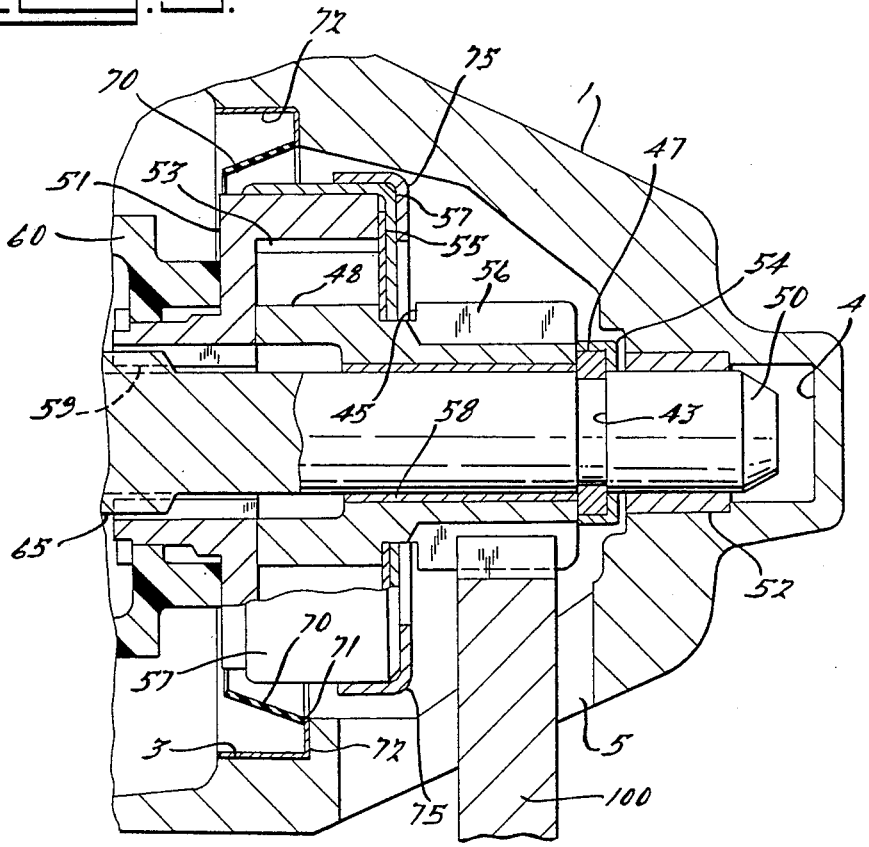
FIG. 3 illustrates the partial cross section portion of FIG. 1 of the present invention in its engaged state with respect to the driven gear.

In FIG. 3, the assembly is shown in its energized (second) position. In that position, the overriding clutch 51 and the pinion gear 56 have been translated so that the pinion gear 56 is engaged with the driven gear 100 extending from the engine. The motor then rotationally drives the output shaft 50 and the rollers 53 force the shank 48 to impart corresponding rotary motion onto the pinion gear 56. Upon commencement of translation of the clutch/pinion gear assembly to its second position, the seal between the annular elastomer lip flange 70 and the cylindrical sealing member 75 is broken. Therefore, when the clutch/pinion gear assembly is subsequently rotated the seal is not subject to binding or seizing as is the case with many of the prior art examples noted above.

The temporary breaking of the seal during the period that the pinion gear is engaged with the driven gear 100 is acceptable, since the period of energization for a starter motor is normally of an extremely small percentage of the actual vehicle use and almost never occurs when the vehicle is in motion. Accordingly, the instances of moisture and other contaminants being driven past the broken seal during the periods of starter motor energization is minimal and acceptable, given the benefits of having a seal which functions over substantially the entire life of the motor.

It is apparent that many modifications and variations may be implemented without departing from the scope of the novel concept of this invention. Therefore, it is intended by the appended claims to cover all such modifications and variations which fall within the true spirit and scope of the invention.

What is claimed is:

1. A starter motor for an engine having a driven gear comprising:

an electric motor;

an output shaft mounted for rotation about its axis by said electric motor;

a pinion gear, having a first portion containing a plurality of gear teeth for engaging said driven gear and a shank portion adjacent thereto, mounted on said output shaft for slidable movement along said output shaft between a first position in which the gear teeth are out of engagement with said driven gear and a second position in which the gear teeth are engaged with said driven gear;

an overriding clutch mounted on said output shaft for rotation therewith and engaged with said pinion gear for slidable movement therewith to provide a frictional one way rotational engagement with said pinion gear;

a housing for said motor containing an internal portion surround the overriding clutch and defining a space between said housing and said clutch to allow movement of said clutch with said pinion gear both along, and in rotation with, said output shaft;

an annular shaped member retained on said internal portion of said housing having an annular lip portion extending to said space defined between said housing and said clutch; and cylindrical sealing member mounted on said clutch having an outwardly extending flange for contacting said annular lip portion when said pinion gear is in said first position and for breaking contact with said annular lip portion when said pinion gear is moved from its first position.

2. A starter motor as in claim 1, wherein said annular lip portion of said annular shaped member is a resilient elastomer that provides a water tight seal when contacted by said cylindrical sealing member.

3. A starter motor for an engine having a driven gear comprising:

an electric motor;

an output shaft mounted for rotation about its axis by said electric motor;

a pinion gear, having a portion containing a plurality of gear teeth for engaging said driven gear and a shank portion adjacent thereto, mounted on said output shaft for slidable movement along said output shaft between a first position in which the gear teeth are out of engagement with said driven gear and a second position in which the gear teeth are engaged with said driven gear,;

an overriding clutch mounted on said output shaft for rotation therewith and for slidable movement with said pinion gear and engaging said shank portion of said pinion gear to provide a frictional one way rotational engagement with said pinion gear;

a housing for said motor containing an internal portion surrounding the overriding clutch and defining a space between said housing and said clutch to allow unrestricted movement of said clutch with said pinion gear along and with said output shaft;

an annular sealing member retained on said internal portion of said housing having a flange portion extending into said space defined between said housing and said clutch; and an cylindrical member mounted on said clutch having a flange extending into said space and overlapping said sealing member for contacting said annular sealing member when said pinion gear is in its first position.

4. A starter motor as in claim 3, wherein said annular sealing member is a resilient elastomer that provides a water tight seal when contacted by said annular cylindrical member.

5. A starter motor for use with an internal combustion engine having a driven gear that is engageable for starting said engine by said starter motor, comprising:

an electric motor;

a starter output shaft that is rotationally driven about its axis by said electric motor;

a pinion gear slidably mounted on said output shaft for movement between first and second positions on said shaft and for rotation with said output shaft;

means for sliding said pinion gear between said first and second positions on said output shaft;

an overriding clutch connected between said output shaft and said pinion gear for communicating rotational forces from said shaft to said pinion gear and also connected to said sliding means for communication sliding forces from said sliding means to said pinion gear;

a housing for said motor containing an internal portion surrounding the overriding clutch and being spaced from said clutch to allow unrestricted movement of said clutch with said pinion gear along and with said output shaft;

an annular sealing member retained on said internal portion of said housing having a flange portion extending into said space between said housing and said clutch; and an cylindrical member mounted on said clutch having a flange extending into said space and overlapping said sealing member for contacting said annular sealing member when said pinion gear is in its first position and for not contacting said annular sealing member when said pinion gear is moved to its second position.

6. A starter motor as in claim 5, wherein said annular sealing member is a resilient elastomer that provides a watertight seal when contacted by said cylindrical member.

7. A starter motor for use with an internal combustion engine comprising:

a housing defining a motor section and pinion gear drive section;

a movable pinion gear located within said pinion gear drive section of said housing for engaging a flywheel on said engine during the start cycle of the engine;

a clutch element engaged with said pinion gear movable from a predetermined first position to communicate rotational and axial movement forces to said pinion gear;

means within said motor section connected to said clutch element for providing said rotational and axial movement forces;

said clutch element and said housing containing overlapping sealing elements to prevent water and other contaminants from passing from said pinion gear section to said motor section only when said clutch element is at its first position.

8. A starter motor as in claim 7, wherein said sealing element on said housing includes a resilient annular lip extending towards said clutch element when said clutch element is in its first position, and said sealing element on said clutch element contains a cylindrical member that extends towards said housing to overlap and to contact said resilient annular lip extending from said housing when said clutch is in its first position.

* * * * *